US007052308B2

(12) United States Patent
Drane et al.

(10) Patent No.: US 7,052,308 B2
(45) Date of Patent: May 30, 2006

(54) RECEPTACLE RETAINER FOR SNAP-IN STYLE RECEPTACLES

(75) Inventors: Mark R. Drane, Germantown, TN (US); Cong Thanh Dinh, Collierville, TN (US); Dan Michaelis, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/115,787

(22) Filed: Apr. 27, 2005

(65) Prior Publication Data

US 2005/0250370 A1 Nov. 10, 2005

Related U.S. Application Data

(60) Provisional application No. 60/569,575, filed on May 10, 2004.

(51) Int. Cl.
*H01R 4/24* (2006.01)

(52) U.S. Cl. ..... 439/417; 439/942

(58) Field of Classification Search ..... 439/404, 439/417, 419, 557, 558, 942
See application file for complete search history.

(56) References Cited

U.S. PATENT DOCUMENTS

| | | | | |
|---|---|---|---|---|
| 3,860,319 | A * | 1/1975 | Slater | 439/400 |
| 4,136,919 | A | 1/1979 | Howard et al. | |
| 4,230,386 | A | 10/1980 | Farnworth et al. | |
| 4,245,880 | A * | 1/1981 | Zimmerman et al. | 439/405 |
| 4,283,102 | A | 8/1981 | Richier | |
| 5,112,237 | A | 5/1992 | Yang | |
| 5,429,518 | A | 7/1995 | Chen | |
| 5,595,494 | A | 1/1997 | Wiebe | |
| 5,607,323 | A * | 3/1997 | Foster et al. | 439/557 |
| 5,795,179 | A * | 8/1998 | Lin | 439/441 |
| 5,902,140 | A | 5/1999 | Cheung et al. | |
| 6,305,956 | B1 | 10/2001 | Deng | |
| 6,406,308 | B1 | 6/2002 | Wang | |

* cited by examiner

*Primary Examiner*—Tho D. Ta
(74) *Attorney, Agent, or Firm*—Hoffmann & Baron, LLP

(57) ABSTRACT

A retaining device for a surface mounted electrical receptacle that includes: a substantially flat base plate, wherein the base plate connects to the receptacle; and a plurality of legs extending outwardly and upwardly from the base plate. The plurality of legs are adapted to contact the back side of the mounting surface and secure the electrical receptacle to the base plate.

19 Claims, 4 Drawing Sheets

RECEPTACLE RETAINER FOR SNAP-IN STYLE RECEPTACLES

This application claims priority from provisional application Ser. No. 60/569,575, filed on May 10, 2004.

FIELD OF THE INVENTION

The present invention relates to power strips with snap-in style receptacles. In particular, the present invention relates to a device for retaining snap-in style receptacles in place.

BACKGROUND OF INVENTION

Power strips are well known and typically include a housing, a plurality of receptacles for the connection of electrical devices and an electrical power cord. The housing is usually a sheet metal or plastic enclosure with apertures for individually receiving the electrical receptacles and may also include switches, indicating lights, surge protection devices and fuses or circuit breakers.

Existing snap-in receptacles used in power strips rely strictly on the snap interface between the receptacle body and the sheet metal enclosure to hold the receptacle in place. Typically, the snap-in receptacle is inserted through an aperture in a power strip enclosure and engages a base which is connected to an electrical power source by two or three wires. The base is located inside the power strip enclosure and is secured in place by clips or retaining devices which engage the interior surface of the enclosure around the receptacle aperture. However, these retaining devices are often insufficient and a common problem with the power strips is retaining the receptacles in the enclosure when a plug is removed from the receptacle. If the plug is fitted too tightly into the receptacle, the force used to remove the plug results in the receptacle being pulled out of the power strip enclosure. Accordingly, there is a need for a snap-in receptacle that is more permanently secured in the power strip enclosure.

SUMMARY OF THE INVENTION

In accordance with the present invention, a retaining device for an electrical receptacle is provided. In particular, the retaining device is used for receptacles that are connected to a receptacle base through an aperture in a wall panel, housing or enclosure, such as a power strip. The retaining device includes a plurality of legs which extend outwardly and upwardly from the receptacle base and engage the underside of the panel or enclosure around the aperture. The legs secure the receptacle and the base in place when force is exerted on the receptacle base to remove a plug from the receptacle.

One embodiment of the retaining device is used for a surface mounted electrical receptacle. The surface has a front side and a back side and the retaining device includes: a substantially flat base plate, wherein the base plate connects to the receptacle; and a plurality of legs extending outwardly and upwardly from the base plate. The plurality of legs are adapted to contact the back side of the surface and secure the electrical receptacle to the base plate. The surface can be any substantially flat surface, such as a plate, a wall, an enclosure or a housing. In preferred embodiments, the connection between the base plate and the receptacle is a snap-in connection formed by one or more retaining clips, preferably flexible retaining clips, and/or one or more members extending upwardly from the base plate, which releasably engage the base plate and the receptacle.

In a preferred embodiment, the base plate has opposing sides and at least one of the plurality of legs extends outwardly from each opposing side. More preferably, two legs extend outwardly from each opposing side. The electrical receptacle accommodates a plug and the plurality of legs prevents the receptacle from being disconnected from the base plate when the plug is removed. The base plate also can have one or more apertures for testing the receptacle. In preferred embodiments, the base plate and legs are formed from a plastic material.

In another embodiment of the retaining device for a surface mounted electrical receptacle, the surface has a front side, a back side and an aperture with opposing sides for receiving the receptacle. The retaining device includes: a substantially flat base plate, wherein a portion of the receptacle is inserted in the aperture and connects to the base plate; and a plurality of legs extending outwardly and upwardly from the base plate. The base plate has opposing sides and at least one of the plurality of legs extends outwardly from each opposing side. The surface can be a plate, a wall or a housing and the plurality of legs are adapted to contact the back side of the surface adjacent to the opposing sides of the aperture in order to secure the electrical receptacle to the base plate. Preferably, the connection between the base plate and the receptacle is a snap-in connection.

The retaining device can also have one or more retaining clips which extend upwardly from the base plate and engage the receptacle to connect it to the base. Preferably, the base plate has opposing sides and two legs extend outwardly from each of the opposing sides. When a plug is removed from the receptacle, the legs prevent the receptacle from being disconnected from the base plate. The base plate can also have one or more apertures for electrically connecting the receptacle to an electrical power source.

In a most preferred embodiment of the retaining device for a surface mounted electrical receptacle, the surface has a front side, a back side and an aperture with opposing sides for receiving the receptacle and the retaining device includes: a substantially flat base plate; a plurality of legs extending outwardly and upwardly from the base plate; and one or more retaining clips which extend upwardly from the base plate and engage the receptacle. A portion of the receptacle is inserted in the aperture and connects to the base plate, preferably using a snap-in connection. The base plate has opposing sides and at least one of the plurality of legs extends outwardly from each opposing side and contacts the back side of the surface adjacent to the aperture in order to secure the electrical receptacle to the base plate.

BRIEF DESCRIPTION OF THE FIGURES

Other objects and many attendant features of this invention will be readily appreciated as the invention becomes better understood by reference to the following detailed description when considered in connection with the accompanying drawings wherein.

DETAILED DESCRIPTION OF THE INVENTION

The present invention is a retaining device for snap-in receptacles that are used in electrical power strips. The retaining device of the present invention includes a plurality of vertical projections or legs, preferably four, which are permanently attached to a receptacle base used in a power strip. These legs engage the interior surface of the power strip enclosure around the receptacle aperture and prevent the receptacle base from passing through the aperture when a plug is removed from the receptacle. The legs can be used alone or in addition to clips and retaining devices that are currently used to secure receptacle bases. When a plug is pulled out of a receptacle in a power strip, the force exerted on the receptacle base is distributed among the legs. Thus, the retaining device of the present invention improves receptacle base retention between the base and the power strip enclosure in which the receptacle is mounted.

Although the invention is directed to power strip enclosures, the retaining devices can be used in any application where a snap-in receptacle is used. For example, the retaining device can also be used in panels and other types of enclosures. The retaining device can be used in any application where en electrical receptacle is surface mounted. The retaining device uses a standard receptacle base and adds vertical projections which extend outwardly and upwardly to engage the bottom of the wall or surface, such as a sheet metal plate, in which the receptacle is mounted. The retaining device preferably includes four legs (vertical projections) but more than four legs and as few as two legs can be used. The legs are preferably L-shaped but they can also have other shapes, such as a curved shape. When a receptacle is mounted through an aperture in a panel or enclosure, the legs projecting upwardly from the receptacle base contact the surface around the aperture.

The power strips that are presently being used are designed so that the snap-in receptacle is tightly secured to the receptacle base but the receptacle base is less tightly secured to the power strip enclosure. Therefore, when too much force is exerted on a plug being removed from the receptacle, the receptacle base will be separated from its mounting in the enclosure rather than the snap-in receptacle separating from the receptacle base. Thus, the retaining device of the present invention provides a significant improvement by more securely maintaining the receptacle base in the power strip enclosure.

When force is applied to the receptacle (such as when a plug is removed) the force is transmitted to the legs on the snap-in receptacle base. The legs contact the underside of the enclosure wall around the receptacle aperture and prevent the receptacle body from coming loose and being pulled out of the enclosure.

Figure 1:
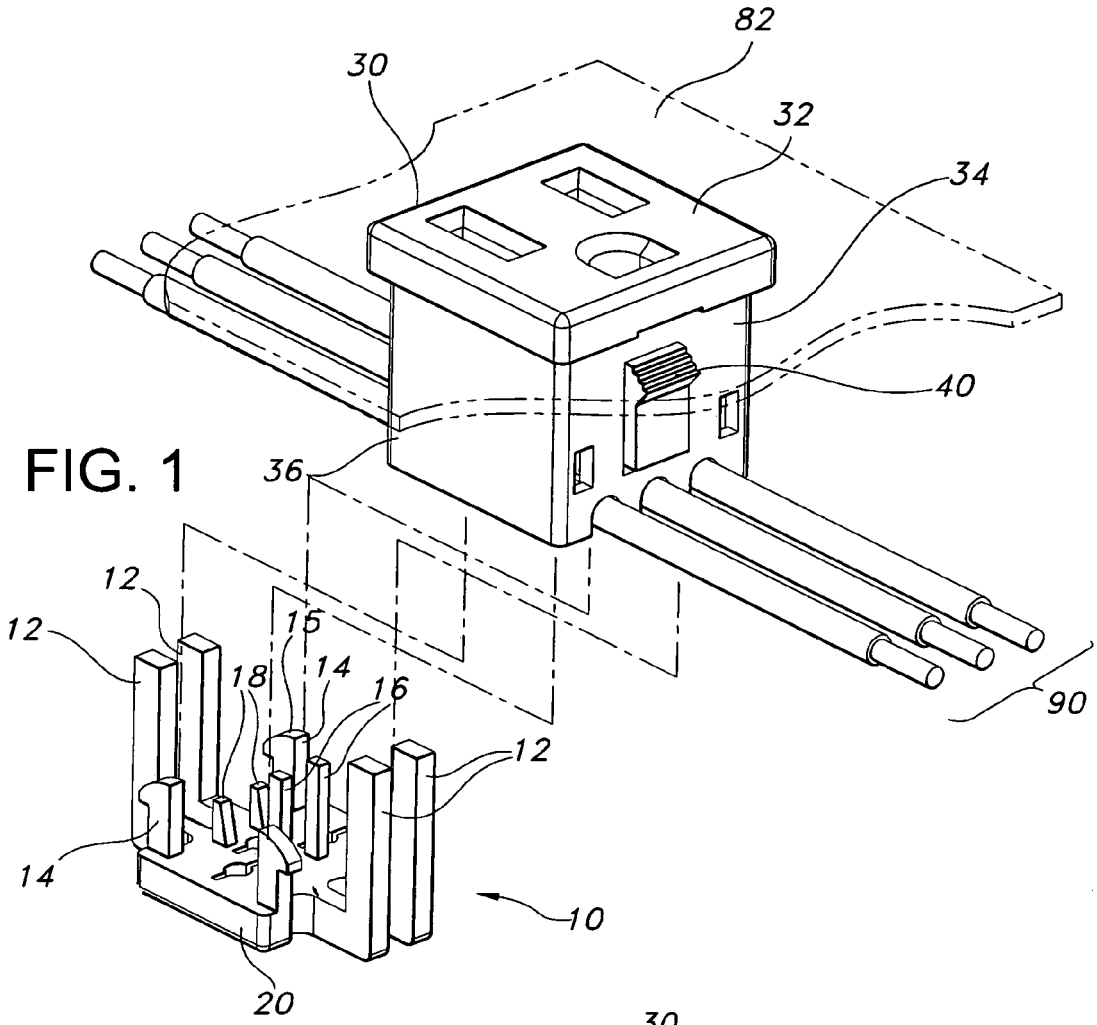
FIG. 1 is a perspective view of the snap-in receptacle and the unconnected receptacle base.

Referring now to the drawings, FIG. 1 shows a snap-in receptacle 30 that is mounted in the top wall 82 (shown in phantom) of a power strip through an aperture and connected to three conductors 90 for the electrical power supply. The receptacle 30 has a cube shaped body 34 with four side walls 36, a socket face 32 on the top which extends beyond the side walls 36 and a bottom side (not shown) that engages the receptacle base 10. The aperture in the top wall 82 is sized so that the side walls 36 of the receptacle 30 pass through the aperture but the underside of the socket face 32 that extends beyond the side walls 36 contacts the top wall 82 of the power strip around the aperture.

FIG. 1 shows the receptacle base 10 before it engages the snap-in receptacle 30. The receptacle base 10 has a plurality of retaining clips 14 and retaining members 16, 18 which engage the snap-in receptacle 30 and secure it in the power strip. The receptacle base 10 also has a plurality of legs 12, preferably four, which extend outwardly and upwardly to engage the interior side of the top wall 82 of the power strip. Side wall clips 40 can also be used to secure the receptacle 30 in place.

Figure 2:
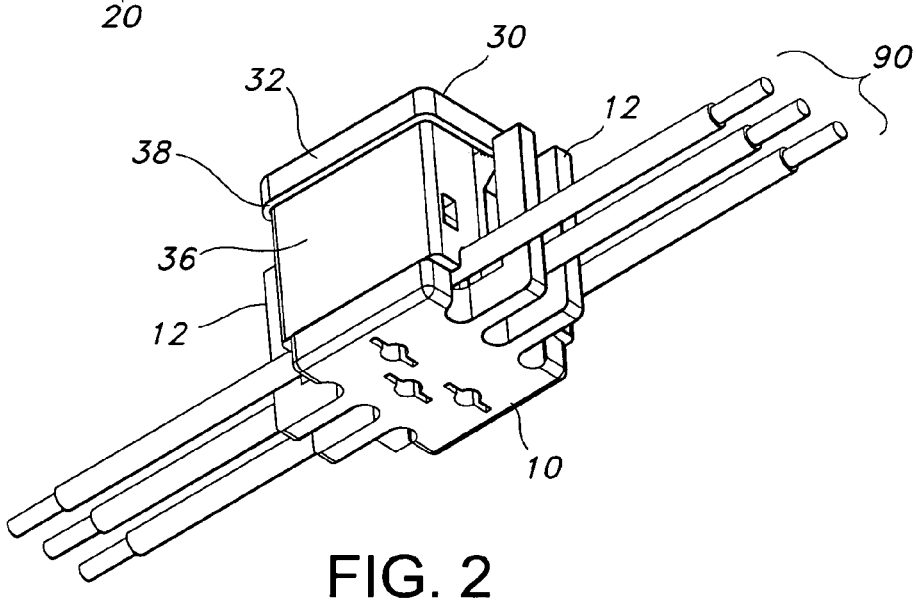
FIG. 2 is a perspective view of the snap-in receptacle connected to the receptacle base.

FIG. 2 shows the snap-in receptacle 30 connected to the receptacle base 10 with the legs 12 extending upwardly to just below the underside of the socket face 32. FIG. 2 also shows how the socket face 32 extends beyond the side walls 36 and forms a lip 38 which contacts the top wall 82 of the power strip.

Figure 3:
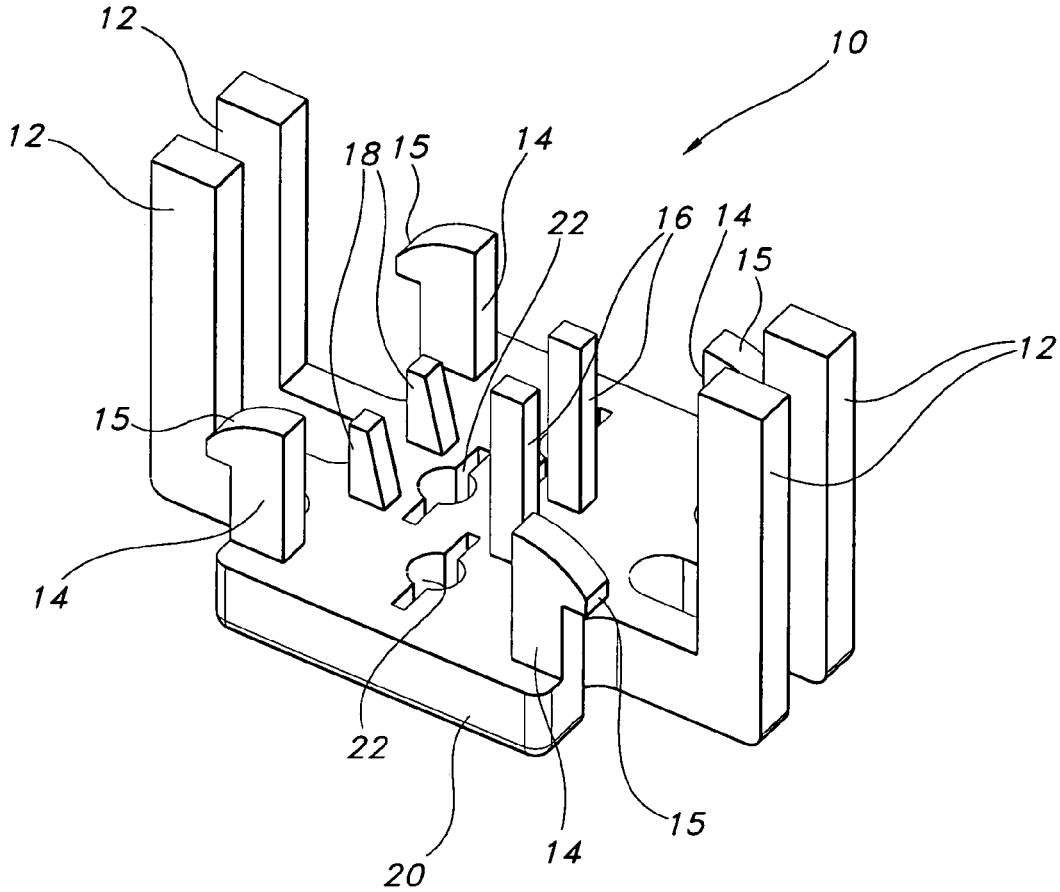
FIG. 3 is a perspective view of the receptacle base.

FIG. 3 shows the receptacle base 10 in more detail. The receptacle base 10 includes a substantially flat plate 20 with two legs 12 extending outwardly and upwardly from opposing sides. FIG. 3 shows a preferred embodiment of the present invention, wherein the legs are L-shaped and extend outward from the plate 20 and then upward. The plate 20 also includes one or more retaining clips 14 which extend upwardly and terminate in an engaging member 15. The engaging members 15 engage the receptacle 30 when it is snapped into the receptacle base 10. The plate 20 also includes retaining members 16, 18 which engage the receptacle 30 when it is secured to the receptacle base 10 and keep the conductors 90 of the power supply separated. The plate 20 also has apertures 22 which can be use for testing the receptacle 30. Preferably, the plate 20 has three apertures 22 for testing the connection of a standard three conductor power supply.

Figure 4:
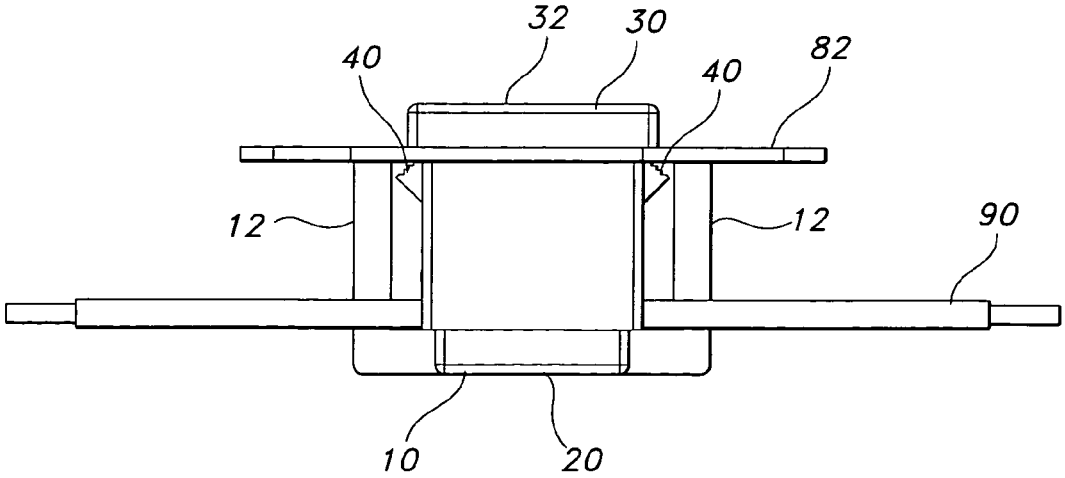
FIG. 4 is a side view of the snap-in receptacle connected to the receptacle base.

FIG. 4 shows a side view of the snap-in receptacle 30 mounted in the top wall 82 of the power strip and connected to the receptacle base 10. The receptacle 30 includes flexible side wall clips 40 which move inwardly when the receptacle 30 is passed through the aperture in the top wall 82 and then spring outwardly to engage the underside of the top wall 82. The side wall clips 40 in combination with the legs 12 of the receptacle base 10 securely retain the receptacle 30 in the power strip.

Figure 5:
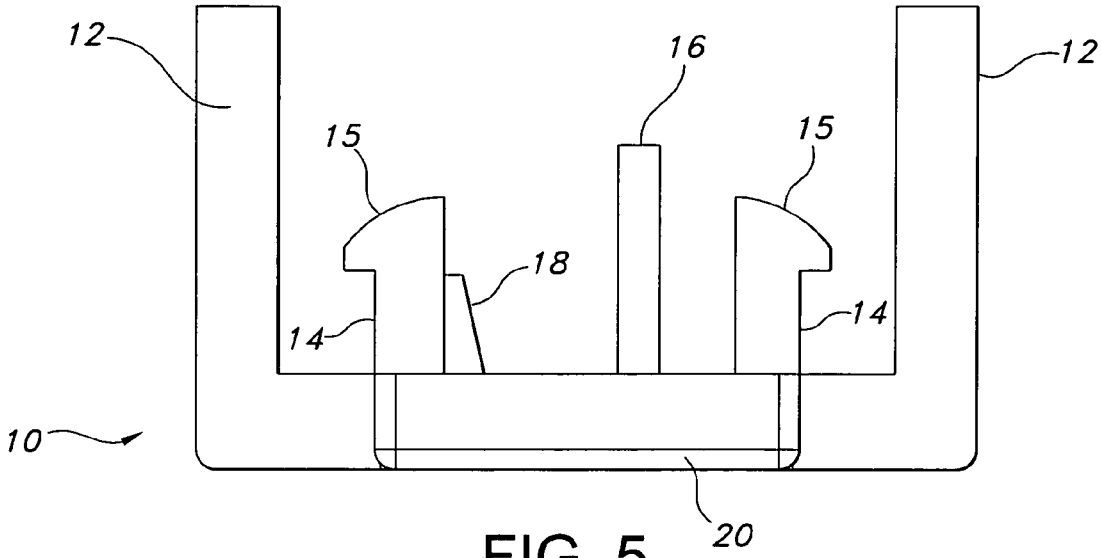
FIG. 5 is a side view of the receptacle base.

FIG. 5 shows a side view of the receptacle base 10 with the legs 12 extending outwardly and upwardly from the plate 20. The retaining clips 14 extend upwardly from the plate 20 and the engaging members 15 extend outwardly from the retaining clips 14. The retaining clips 14 are flexible so that they move inwardly when the receptacle 30 is positioned on the receptacle base 10 and then snap back into position to allow the engaging members 15 to engage the receptacle 30 (as shown in FIG. 1). The curved top portion of the engaging members 15 facilitates the insertion of the receptacle 30 and, when the receptacle 30 passes over the engaging members 15, the retaining clip 14 returns to its normal upright position to provide the snap-in connection. In addition, retaining members 16, 18 extend upwardly from the plate 20 and also engage the receptacle 30. In addition, these retaining members 16, 18 are used to maintain separation between the conductors 90 (not shown) of the power supply.

Figure 6:
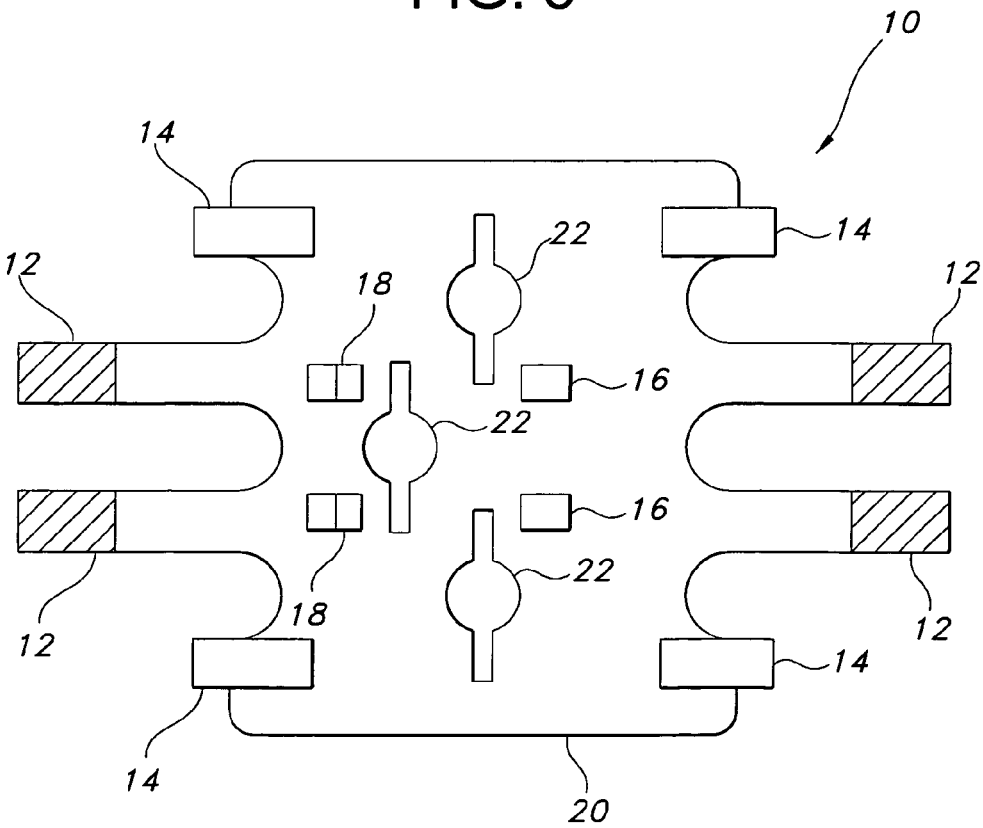
FIG. 6 is a top view of the receptacle base.

FIG. 6 shows a top view of the receptacle base 10 with the legs 12 extending outwardly from opposing sides. The retaining clips 14 which engage the receptacle 30 (not shown) are positioned at the four corners of the plate 20. The apertures 22 in the plate 20 are used for testing and allow electrical contact with the conductors 90 (not shown) for the power supply.

Figure 7:
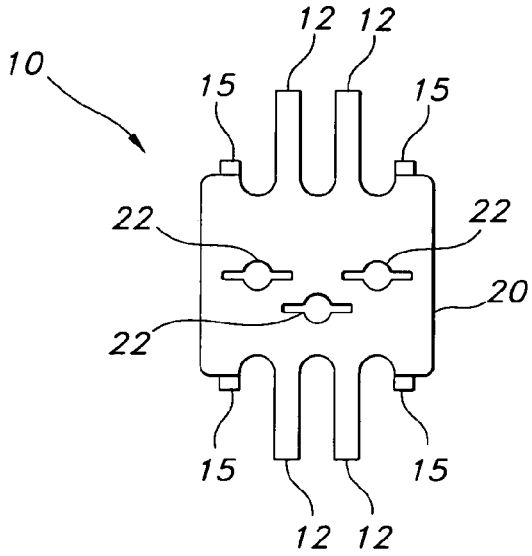
FIG. 7 is a bottom view of the receptacle base.

FIG. 7 is a bottom view of the receptacle base 10 showing the legs 12 extending outwardly from the plate 20 and the engaging member 15 of the retaining clip 14 extending beyond the plate 20. The apertures 22 in the plate 20 are also shown.

Figure 8:
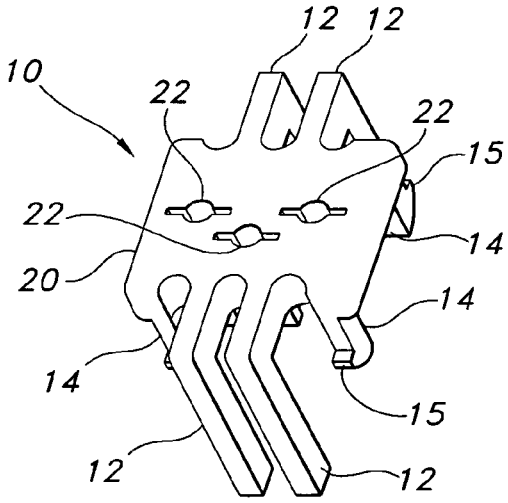
FIG. 8 is a perspective view of the receptacle base.
Figure 9:
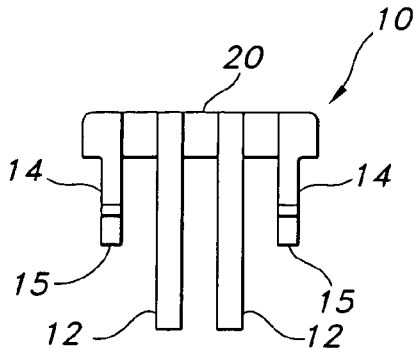
FIG. 9 is an end view of the receptacle base.

FIG. 8 is a perspective bottom view of the receptacle base 10 and shows the legs 12 and retaining clips 14. FIG. 9 is an end view of the receptacle base 10 and shows the legs 12 and the retaining clips 14 with the engaging members 15.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A retaining device for a surface mounted electrical receptacle, wherein the surface has a front side and a back side, the retaining device comprising:

a substantially flat base plate, wherein the base plate is disposed on the back side of the surface and connects to the surface mounted electrical receptacle; and a plurality of legs extending outwardly and upwardly from the base plate, wherein each leg terminates in an end, wherein the ends of the plurality of legs are adapted to contact the back side of the surface and secure the surface mounted electrical receptacle in place.

2. The retaining device of claim 1, wherein the surface is a plate, a wall or a housing.

3. The retaining device of claim 1, wherein the connection between the base plate and the receptacle is a snap-in connection.

4. The retaining device of claim 1, further comprising a one or more retaining clips extending upwardly from the base plate and engaging the receptacle.

5. The retaining device of claim 1, wherein the base plate has opposing sides and at least one of the plurality of legs extends outwardly from each opposing side.

6. The retaining device of claim 1, wherein the base plate has opposing sides and two legs extend outwardly from each opposing side.

7. The retaining device of claim 1, wherein the receptacle accommodates a plug and wherein the plurality of legs prevents the receptacle from being disconnected from the base plate when the plug is removed.

8. The retaining device of claim 1, wherein the base plate has one or more apertures for testing the receptacle.

9. The retaining device of claim 1, wherein the base plate and legs are formed from a plastic material.

10. A retaining device for a surface mounted electrical receptacle, wherein the surface has a front side, a back side and an aperture with opposing sides for receiving the receptacle, the retaining device comprising:

a substantially flat base plate, wherein a portion of the surface mounted electrical receptacle is inserted in the aperture and connects to the base plate on the back side of the surface; and a plurality of legs extending outwardly and upwardly from the base plate, wherein the base plate has opposing sides and at least one of the plurality of legs extends outwardly from each opposing side and wherein each leg terminates in an end, wherein the surface is a plate, a wall or a housing and wherein the ends of the plurality of legs are adapted to contact the back side of the surface adjacent to the opposing sides of the aperture and secure the surface mounted electrical receptacle in place.

11. The retaining device of claim 10, wherein the connection between the base plate and the receptacle is a snap-in connection.

12. The retaining device of claim 10, further comprising one or more retaining clips extending upwardly from the base plate and engaging the receptacle.

13. The retaining device of claim 10, wherein the base plate has opposing sides and two legs extend outwardly from each opposing side.

14. The retaining device of claim 10, wherein the receptacle accommodates a plug and wherein the plurality of legs prevents the receptacle from being disconnected from the base plate when the plug is removed.

15. The retaining device of claim 10, wherein the base plate has one or more apertures for testing the receptacle.

16. A retaining device for a surface mounted electrical receptacle, wherein the surface has a front side, a back side and an aperture with opposing sides for receiving the receptacle, the retaining device comprising:

a substantially flat base plate, wherein a portion of the surface mounted electrical receptacle is inserted in the aperture and connects to the base plate, wherein the connection between the base plate and the receptacle is a snap-in connection;

a plurality of legs extending outwardly and upwardly from the base plate, wherein the base plate has opposing sides and at least one of the plurality of legs extends outwardly from each opposing side; and one or more retaining clips extending upwardly from the base plate and engaging the receptacle, wherein the surface is a plate, a wall or a housing and wherein the plurality of legs are adapted to contact the back side of the surface adjacent to the opposing sides of the aperture and secure the surface mounted electrical receptacle in place.

17. The retaining device of claim 16, wherein the base plate has opposing sides and two legs extend outwardly from each opposing side.

18. The retaining device of claim 16, wherein the receptacle accommodates a plug and wherein the plurality of legs prevents the receptacle from being disconnected from the base plate when the plug is removed.

19. The retaining device of claim 16, wherein the base plate has one or more apertures for testing the receptacle.

* * * * *